US009227698B2

(12) United States Patent
Walker

(10) Patent No.: US 9,227,698 B2
(45) Date of Patent: Jan. 5, 2016

(54) OPEN BOW INFLATABLE BOAT WITH REMOVABLE FRAME

(71) Applicant: Kris Walker, Bow, WA (US)

(72) Inventor: Kris Walker, Bow, WA (US)

( * ) Notice: Subject to any disclaimer, the term of this patent is extended or adjusted under 35 U.S.C. 154(b) by 76 days.

(21) Appl. No.: 14/267,286

(22) Filed: May 1, 2014

(65) Prior Publication Data

US 2015/0314832 A1 Nov. 5, 2015

(51) Int. Cl.
*B63G 8/22* (2006.01)
*B63B 7/08* (2006.01)
*B63B 29/04* (2006.01)

(52) U.S. Cl.
CPC . *B63B 7/082* (2013.01); *B63B 7/08* (2013.01); *B63B 7/085* (2013.01); *B63B 2029/043* (2013.01)

(58) Field of Classification Search
CPC ..... B63B 7/00; B63B 7/08; B63B 7/082; B63B 7/085; B63B 2700/00; B63B 2007/06; B63B 2017/0045; B63B 2059/08; B63B 2029/043
USPC ..... 114/43, 345, 361, 364
See application file for complete search history.

(56) References Cited

U.S. PATENT DOCUMENTS 4,919,067 A * 4/1990 Wenstob ..... B63C 7/003 114/121
6,178,911 B1 * 1/2001 Hemphill ..... B63B 7/08 114/345
7,322,309 B2 * 1/2008 Larochelle ..... B63B 7/08 114/345

* cited by examiner

*Primary Examiner* — Daniel V Venne
(74) *Attorney, Agent, or Firm* — Dwayne E. Rogge; Schacht Law Office, Inc.

(57) ABSTRACT

Disclosed herein is a partially inflatable vessel having an open region at the bow and optionally at the stern of the vessel. A removable covering such as a tarp is provided at the bow region to allow access through the open region when the tarp is removed. The hull tarp covers the bow region to improve stability and operation of the vessel when moving through water at significant speeds.

7 Claims, 5 Drawing Sheets

OPEN BOW INFLATABLE BOAT WITH REMOVABLE FRAME

BACKGROUND OF THE DISCLOSURE

Field of the Disclosure

This application relates to the field of inflatable watercraft.

BRIEF SUMMARY OF THE DISCLOSURE

Disclosed herein is an open bow inflatable boat to operate on water comprising: port and starboard longitudinal inflatable hull pontoons; an inflatable floor attached to and extending between the port and starboard hull pontoons; a bow pontoon continuous with the port and starboard longitudinal inflatable hull pontoons; the bow pontoon forward of and above the inflatable floor; surfaces defining an open bow region bounded by the port and starboard hull pontoons, bow pontoon, and the inflatable floor; a hull tarp exterior of the bow pontoon and releasably in contact with the bow pontoon so as to selectively cover the open bow region.

The open bow inflatable boat as recited herein in one example is disclosed as further comprising: a stern pontoon continuous with the port and starboard longitudinal inflatable hull pontoons; the stern pontoon forward of and above the inflatable floor; and surfaces defining an open stern region bounded by the port and starboard hull pontoons, bow pontoon, and the inflatable floor.

The open bow inflatable boat as recited herein may be arranged wherein the inflatable floor comprises tapered tubes which are larger in a vertical dimension at an aft end than at a forward end.

The open bow inflatable boat as recited herein may further comprise: a frame removably attached to and extending between the port and starboard longitudinal inflatable hull pontoons.

The open bow inflatable boat as recited herein may be arranged wherein the frame is modular comprising components selected from the list consisting of: a seat, transverse frame members, longitudinal frame members, control console, storage locker, and a rigid floor section.

The open bow inflatable boat as recited herein may further comprise: a plurality of straps having a first end attached to the hull tarp and a second end comprising a fastening mechanism; a float which is lighter than water attached to each strap between the first end and the second end; and wherein each float has sufficient positive buoyancy to maintain the fastening mechanism at the water's surface.

The open bow inflatable boat as recited herein may further comprise: a plurality of fastening points fixed to the boat; a plurality of quick release fasteners removably attaching the bow section of the hull tarp to the bow portion of the boat.

DETAILED DESCRIPTION OF THE DISCLOSURE

Disclosed herein is a novel open bow inflatable boat which in one example has a removable frame. Inflatable water craft are well-known for their benefits in rescue and support applications due to their inherently buoyant and non-rigid nature. For example, when rescuing personnel from rigid craft etc., an inflatable craft can be pulled right up to and against the rigid craft without damaging either vessel as the inflatable pontoons of the inflatable craft will absorb some shock or impact. In addition, when rescuing people, animals, or other items from the water, it is easy to pull alongside and then "drag" the item over the side of the inflatable pontoons into the flooring section. As the inflatable pontoons at least slightly conform to the retrieved item brought on board, there is less likelihood of injury or damage to either the boat or the retrieved item brought on board. Henceforth the term "retrieved item" will be used to encompass people, animals, or other items.

Traditionally, the aft end of inflatable craft comprises a rigid transom with a motor attached thereto. Such a raised rigid transom and motor makes retrieval or items and people from the water at the aft end of the vessel difficult. As the bow of most inflatable craft is relatively high above the mean water line compared to the side pontoons, it is more difficult to transfer a retrieved item over this bow region than over the side pontoons. Thus, the most common retrieval method is to pull the vessel alongside the item and transfer the item over the side pontoons.

In some instances, where the retrieved item is significantly heavy in relation to the strength and/or lifting ability of the person bringing the retrieved item onto the boat, it would be desirous to have less of a vertical lift required to bring the retrieved item on board. To this end, the open bow inflatable boat disclosed herein is particularly well suited.

Figure 1:
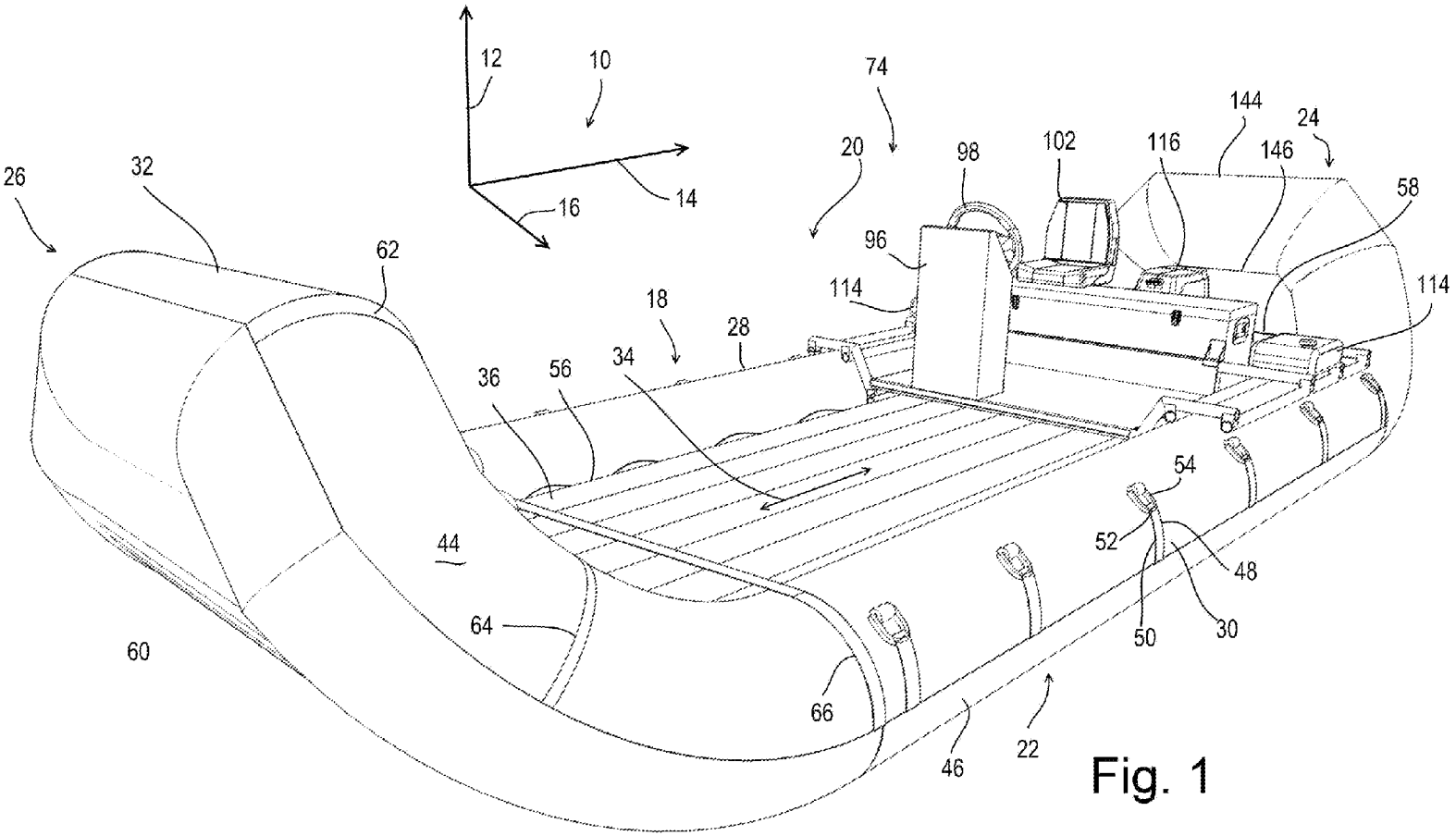
FIG. 1 is a front isometric view of one example of the Open Bow Inflatable Boat/Vessel.

Before beginning a detailed description of the components shown in the drawings, an axes system 10 is disclosed in FIG. 1 as comprising a vertical axis 12, longitudinal axis 14 generally aligned with the direction of travel of the boat 20 (forward and reverse) and a transverse axis 16 orthogonal to both the vertical axis 12 and the longitudinal axis 14. In addition, the nautical terms for regions of the boat are used such as a starboard side 18, port side 22, stern end 24 and bow end 26. These axes are intended for aid in disclosure and are not intended to limit the invention to a single orientation.

Figure 2:
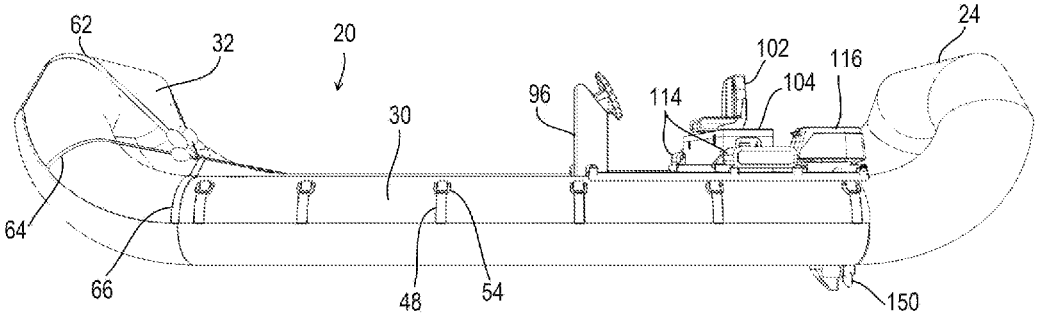
FIG. 2 is a side view of the example shown in FIG. 1.

Looking to FIG. 1 is shown one example of the open bow inflatable boat 20. This example comprises a starboard pontoon 28 and a port pontoon 30 which are each normally inflatable. Although these pontoons are shown in the Figs. as cylinders having a major axis aligned in the longitudinal direction 14, these pontoons 28, 30 may also be of other shapes. Forward of and substantially (externally) continuous with each of the starboard pontoon 28 and port pontoon 30 is a bow pontoon 32. The bow pontoon 32 in this example is arcuate in a vertical direction 12 as well as in a transverse 16 direction inward toward the transverse centerline 34 of the boat 20 as can be seen when looking to FIGS. 1, 2, and 3. In addition, an inflatable floor 36 map be provided. The inflatable floor 36 extends between the starboard pontoon 28 and the port pontoon 30 so as to provide a soft secure surface for operators to stand upon as well as a surface to store items upon such as the retrieved items previously discussed. Several examples of this inflatable floor 36 will be described in more detail.

By so forming these pontoons and the inflatable floor, an open region 38 may be formed bounded in one example by the port hull pontoon 22, starboard hull pontoon 28, floor 36, and bow pontoon 32. It can be appreciated that as the starboard hull pontoon 28 and port hull pontoon 30 are substantially continuous with the bow pontoon 32 it may be difficult (at least visually) to appreciate the distinction there between. For example, in one example the bow pontoon 32 may be formed so as to contact with the inflatable floor 36 at both the port and starboard sides such that the open region 38 is defined by these components (bow pontoon and floor) alone.

Figure 3:
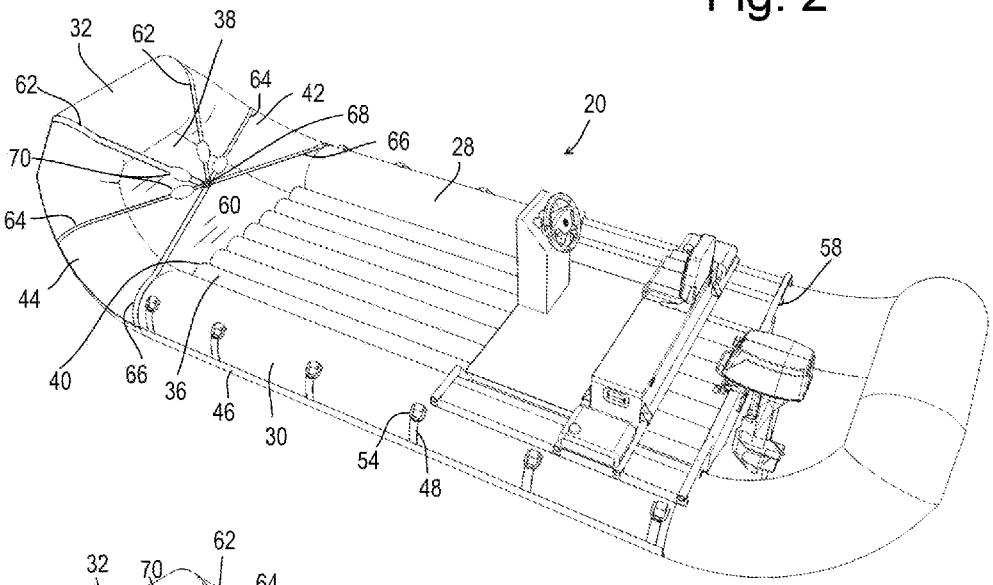
FIG. 3 is a top isometric view of the example shown in FIG. 1.
Figure 4:
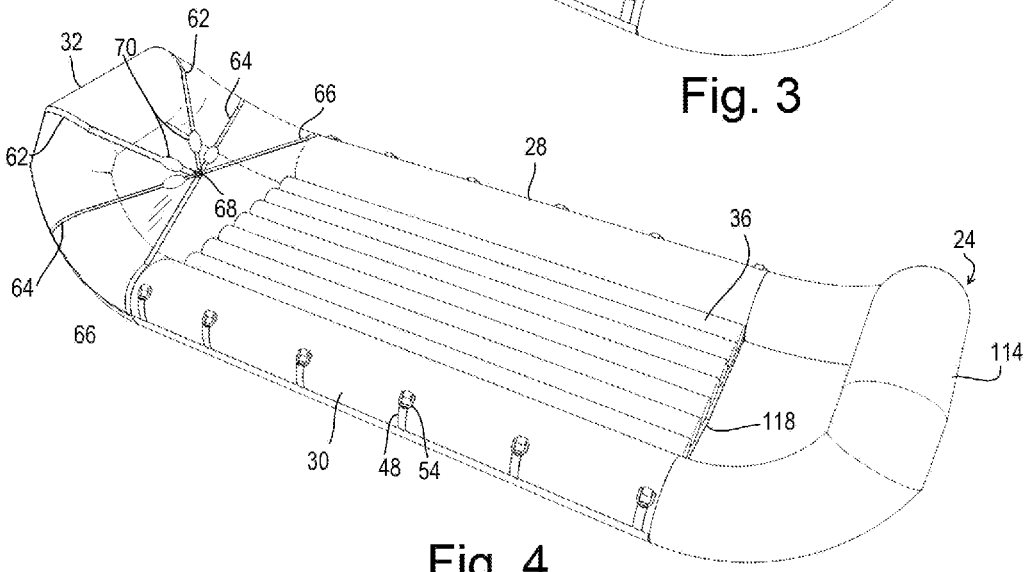
FIG. 4 is a top isometric view of the example shown in FIG. 1 with a frame removed to show the underlying components.

In the example shown in FIG. 3, the hull pontoons include a starboard bow pontoon 42 and a port bow pontoon 44 substantially continuous with the starboard hull pontoon 28 and port hull pontoon 36 respectively. The starboard bow pontoon 42 and the port bow pontoon 44 may also be substantially continuous with the bow pontoon 32. Each of these pontoons may be internally segmented into individually inflated compartments for safety or may be internally continuous.

This open region 38 at the bow of the inflatable boat is unique in that when the boat is pulled directly up to a an item to be retrieved at the forward end 40 of the floor 36 aft of the bow pontoon 32; the item to be retrieved may be drawn directly onto the floor 36 without requiring the item to be retrieved being brought over any of the hull pontoons 28, 30, 32 as it will be brought under at least a portion of the bow pontoon 32.

In testing, it is been shown that such an open bow design is less than perfectly effective when the boat 20 is driven at speed in that the water through which the boat 20 traverses engages the forward end 40 of the floor 36 in a detrimental manner. Thus, in at least one example, a hull tarp 46 is provided beneath the inflatable hull and floor or at least below the bow portion 26 forward of the inflatable floor 36. In example shown, the hull tarp 46 is attached by way of straps 48 each having a first end 50 attached to the hull tarp 46 and a second end 52 attached to one of several eyes 54. In another example, a fastener 152 is used to directly couple the hull tarp to a D-ring 154 or other fastening location on one of the inflatable sections or elsewhere on the vessel. In one form such fasteners 152 may be metal quick releases, Velcro, or functional equivalents. In one form, the hull tarp 46 may also be attached at the seam 56 between the inflatable floor 36 and each of the port and starboard pontoons 30 and 28 respectively. In example shown, the hull tarp extends substantially from the transom 58 to the bow pontoon 32 while in other examples less of the hull of the vessem may be so covered or the hull tarp may be made of separable portions. In another form, the hull tarp extends only from the forward end 40 of the inflatable floor 36 towards the forward leading edge of the bow pontoon 32.

In the example shown, a portion of the hull tarp 46 from the transom 58 forward substantially to the forward end 40 of the inflatable floor 36 is fixed to the inflatable pontoons where as a bow section 60 of the hull tarp 46 extending forward therefrom is releasably mounted to the bow pontoon 32 by way of upper hull tarp strap 62, middle hull tarp strap 64, and lower hull tarp strap 66. Other combinations of straps or releasable fasteners could be utilized. The term "straps" used herein not only to include flat webbing style straps as shown but also ropes, bungees, elastic tubes or bands, and other similar apparatus. Looking in particular to FIG. 3; it can be seen how each of the straps 62, 64, and 66 on both the port and the starboard side of the boat have a first end attached to bow section 60 of the hull tarp 46 and a second end comprising a releasable fastener 68. Although several versions of such releasable fastener 68 may be utilized, simple hooks have been found particularly easy to operate. It has been found that simple open-ended hooks allow for easy manipulation one-handed where other more complicated fasteners require two hands. This is not to preclude the use of other fasters. It can also be seen how in the example shown, at least each of the straps 62 and 64 have a float 70 attached thereto. The reason for the releasable fastener 68 and float 70 will be explained in detail.

Figure 12:
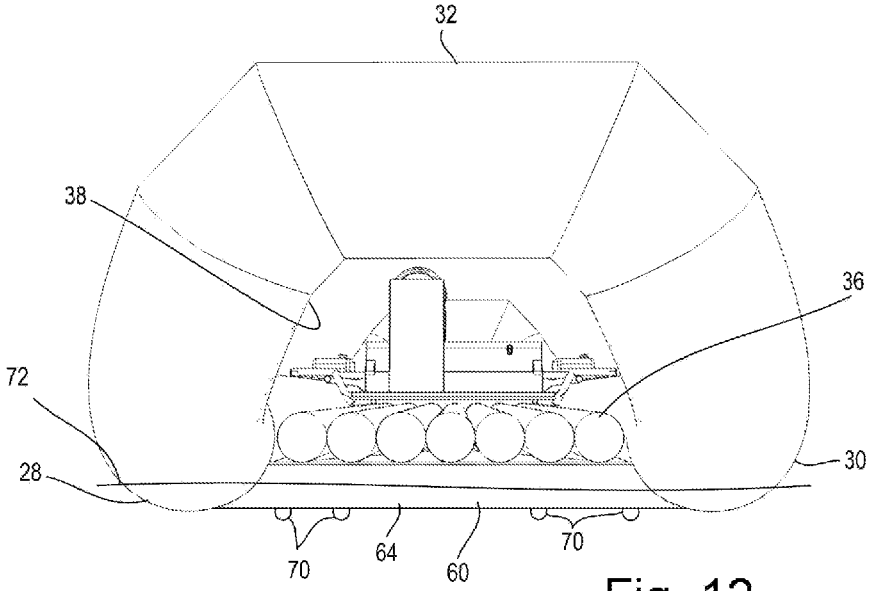
FIG. 12 Is a front view of the Open Bow Inflatable Boat with the bow section of the hull tarp released and positioned under the hull of the boat.

As previously discussed, it is often desired when retrieving an item that the open region 38 of the bow portion 32 as seen in FIG. 12 is not blocked by the bow section 60 of the hull tarp 64 as this open region 30 of the bow 32 allows access from the water directly to the floor 36 slightly above the waterline 72 and under the bow pontoon 32. In one example of operation, once the boat 20 has generally reached the area in which the item is to be retrieved, the boat will be maintained in a forward direction relatively slowly. At which position and speed the releasable fasteners 68 may be released allowing the bow section 60 of the hull tarp 46 to be drawn under the boat by hydrodynamic force. The fastener 68, floats 70, and straps attached thereto may then be repositioned outboard of the hull or pulled into that position as a water presses against the outer surface of the bow section 60 of the hull tarp 64 (hydrodynamic force). Thus drawing the bow section 60 of the hull tarp 64 and the straps 62, 64, 66 and releasable fasteners 68 to the position shown in FIG. 12 beneath the floor 36. The item to be to retrieved can then be easily drawn through the open region 38 onto the floor 36 as the hull tarp no longer occludes the open region 38 and the straps are also out of the way.

Although it is conceived that the floats 70 may maintain the releasable fasteners 68 at or at least near the surface of the water outboard of the hull pontoons, the floats and releasable fasteners 68 may alternatively be positioned beneath the boat as shown in FIG. 12. Once retrieval is accomplished, the boat may be gently reversed; whereupon the water will force the floats 70 forward and/or outboard of the hull pontoons 28, 30, 32 where they may be easily reached by an operator and re-fastened to the position shown in FIG. 3 enclosing the bow for safer and more effective forward movement at speed. In one example, the straps 66 may not require a float 70 as they are attached to the hull tarp at or adjacent the most forward securement position of the hull tarp and therefore can be easily grasped by a user on the inflatable floor 36.

Figure 5:
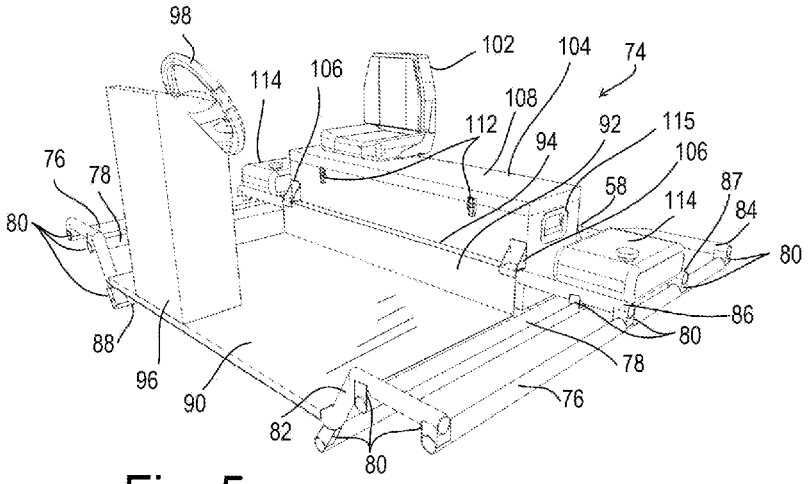
FIG. 5 is a front isometric view of the frame shown in FIG. 1.

To make the boat more easily controlled, a rigid frame assembly 74 may be provided. This rigid frame assembly 74 is shown in FIG. 1. However, FIG. 5 shows this same rigid frame assembly 74 removed from the inflatable portion of the boat 22 more easily show the individual components. As can be understood by looking to FIG. 7, many of these components are easily disassembled for shipping and storage. In addition, the inflatable portions may be easily deflated and then folded or rolled into a compact storage configuration.

This may be exceptionally useful when the boat is to be utilized for example by law enforcement, firefighting, or rescue personnel who may desire to maintain the vessel in a stowed configuration and only assembled and inflated when needed.

Looking back to FIG. 5, the rigid frame assembly 74 can be seen comprising a port outer longitudinal tube 76 which is out board of and substantially parallel tube and inner longitudinal tube 78. These tubes 76 and 78 rest upon and may be fastened to the port pontoon 30. In this way, the entire rigid frame assembly 74 may in one example rest upon the pontoons 28 and 30 alone and not rest upon the inflatable floor 36. These tubes 76 and 78 removably fastened by way of couplings 80 to a forward transverse frame 82 and transom frame 84. In one form a forward transverse tube 86 and a rear transverse tube 87 may also be fastened by way of couplings 82 the tubes 76 and 78. These tubes 76 and 78 repeated on the starboard side of the boat.

Figure 6:
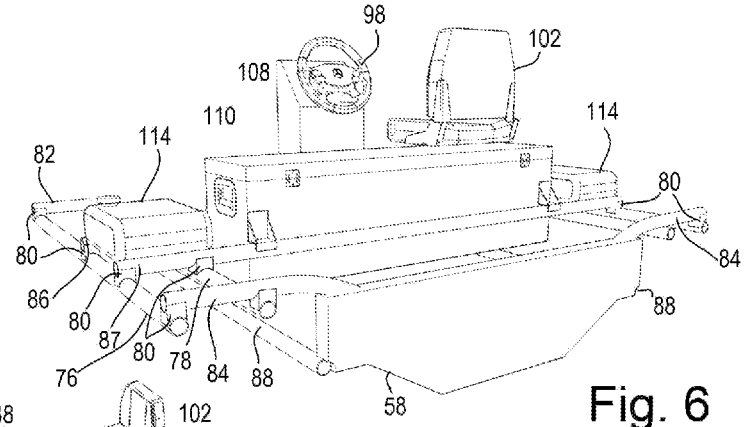
FIG. 6 is a rear is a rear isometric view of the frame shown in FIG. 5.

In addition, a port lower longitudinal tube 88 may also be fastened to the forward transverse frame 82 and transom frame 84 by similar couplings 80 or other mechanisms especially at the transom frame 84. For example, looking to FIG. 6 it is shown that the aft end of each longitudinal tube 88 is mounted by way of clamps, fasteners or other means directly to the transom 58. In one form, the couplings 80 may have a plurality of orthogonally oriented holes therein through which the frame or two this past and then secured by way of plants, bolts, screws rivets etc. in one form, each of the couplings 80 may be welded to one other frame component and then removably fastened to the other. It is conceived that the couplings 80 may alternatively be welded to each of the components to which is fastened for a non-separable connection. In such an assembly, the apparatus may be provided to the end user as shown in FIG. 7, assembled, and then welded into place to form a permanent framework structure.

Figure 7:
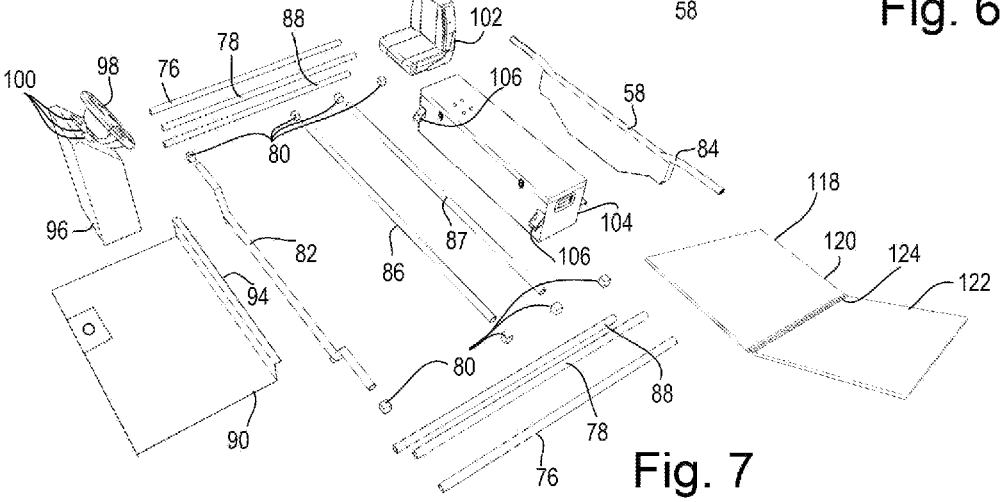
FIG. 7 is an exploded view of the frame components shown in FIG. 5 and rigid hull insert partially shown in FIG. 4.

As can be seen in FIG. 7, the transverse frame 82 is configured to be substantially lower at the center region then at the outboard regions. This allows for a rigid floor section 90 to be attached at the forward and to the transverse frame 82 and in one example at the rearward and to the transverse tube 86. In example shown, this is accomplished by way of a riser 92 and then 94 which rests upon the transverse tube 86.

The rigid floor section 90 may have texturing such as diamond plate on the upper surface thereof for traction as the surface may be walked upon by a user desiring a rigid surface upon which to function when operating the boat 20. In addition, the rigid floor section 90 may provide a secure fastening platform for a console 96. The console 96 supporting a steering apparatus such as a steering wheel 98 as well as instruments 100 which may include speed, oil temperature, magnetic direction (compass) etc. as well as support for any other motor controls such as throttle and transmission etc. As clearly indicated in FIG. 7, the console 96 may be removably attached to the rigid floor section 90.

To provide a rigid support for an optional seat 102, a storage box 104 may be attached to the transverse tubes 86 and 87 by way of brackets 106. In addition, bolts, screws, rivets or other fastening devices may be utilized to maintain the brackets 106 in contact with the tubes 78. The storage box 104 also having a lid 108 connected by way of hinges 110 (see FIG. 6) and one or more hasps 112 four fastening of the lid 108. It may also be desired to provide lifting handles 115 as the storage box 104 may be made of metal and may contain relatively heavy objects.

It is also been found that the transverse tubes 86 and 87 also provide excellent support for one or more fuel tanks 114 being connected by way of fluid conduits to a motor 116 (see FIG. 1). The motor 116 removably mounted to the transcend 58 in a manner well-known in the art.

Figure 8:
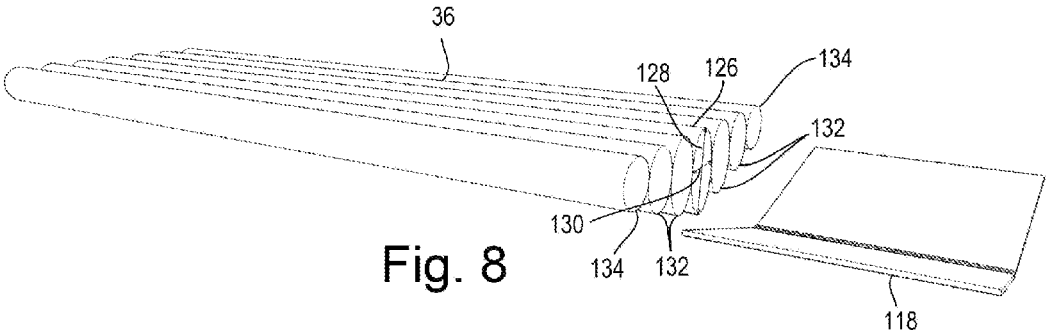
FIG. 8 is an isometric view of one example of the inflatable floor and the rigid hull insert of the example shown in FIG. 4.
Figure 11:
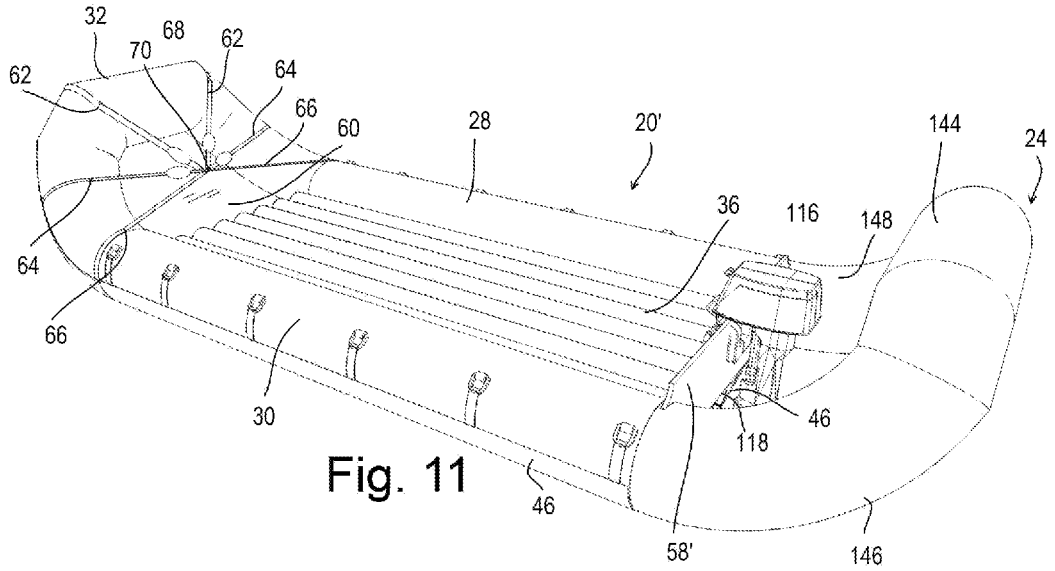
FIG. 11 is a rear isometric view of another example of the Open Bow Inflatable Boat.

In testing, it has been found that speed and maneuverability of an inflatable vessel with an inflatable floor can be greatly improved by way of a rigid hull insert positioned beneath the inflatable floor. One example of this is shown in FIG. 7 as a rigid hull insert 118. While a unitary structure may be utilized, advantages have been found in providing the rigid hull insert 118 as a port section 120 and a starboard section 122 connected by way of a hinge 124. The ports section 120 and starboard section 122 may be formed of laminated materials such as plywood or fiber reinforced plastic. In FIG. 8 it can be seen how the rigid hull insert 118 is positioned near and below the inflatable floor 36. In FIG. 11, an example is shown wherein the whole tart 46 extends substantially to the transom and the rigid hull insert 118 is positioned between the inflatable floor 36 and the hull tarp 46.

Figure 9:
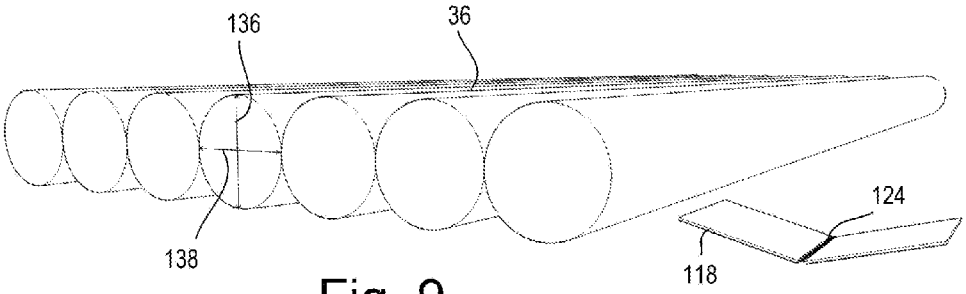
FIG. 9 is a front isometric view of the inflatable floor and rigid hull insert shown in FIG. 4.

In FIG. 8 is shown one example of the inflatable floor 36 being separated from all other components of the boat 20. In this example, the inflatable floor comprises a plurality of longitudinal tubes which when assembled and inflated are not all cylindrical. For example, in the example shown in FIG. 8 the center flooring tube is larger in a vertical dimension 128 then in a transverse dimension 130. In the example shown in the center flooring tube 126 comprises an oval in cross-section. Similarly adjacent median flooring tubes 132 may be substantially smaller in the vertical dimension 128. In one example the outer flooring tubes 134 may be substantially round or circular in cross-section. This providing for a V-shaped hull increasing maneuverability of the boat 20 as commonly found in most boats where it is found that a V-shape significantly improves performance. Looking to FIG. 9, the forward end of one example of these flooring tubes is shown wherein the vertical dimension 136 and transverse dimension 138 is substantially the same. This provides little or no V-shaped near the forward and of the inflatable floor 36. As previously discussed, the rigid hull insert 118 provided at least at the aft end of the flooring tubes to provide a rigid surface and contour for the hull tarp 46.

Figure 10:
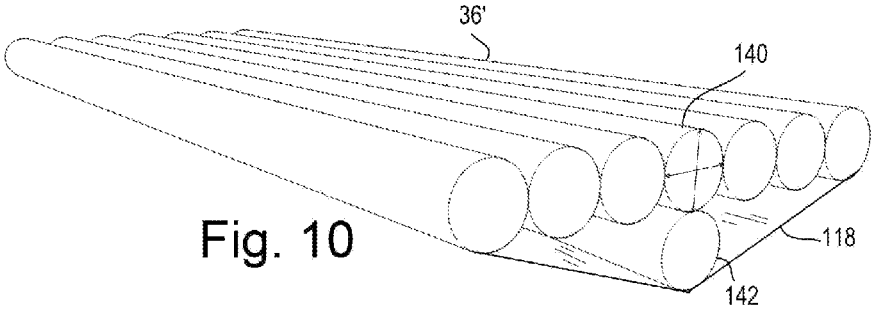
FIG. 10 is a rear isometric view of another example of the inflatable floor of the example shown in FIG. 4.

In the example shown in FIG. 10, each of the flooring tubes 140 has a cross-section which is substantially circular. To provide the desired V-shape at the aft end of the boat 20, a tapered hull tube 142 may be provided below the center section of the flooring tube 140. This tapered hole tube 142 may in one example be substantially larger at the rearward and then at the forward and to provide a tapered V-shape.

Lastly, the example shown in FIG. 11 is fully operable without the frame assembly 74 shown in FIG. 5. In this example, the transom 58' is fixed to the inflatable hull. The motor 116 a then be mounted to the transom 58' in a traditional manner and operated directly.

In either example it is shown that the stern and 24 of the inflatable portion of the boat 20 includes a stern pontoon 144 which has a lower surface 146 (see FIG. 1) which is substantially above the water, in one example above the inflatable floor 36, and in one example even above the transom 58. As shown, the stern pontoon 44 includes aft port pontoons 146 and aft starboard pontoon 148 which are substantially continuous with the port hole pontoon 30 and starboard hole pontoon 28 in one example. This stern pontoon 144 provides protection to the motor 116 and transom 58 and in addition as the forward and of the boat 20 may be very light and susceptible to windage, this stern pontoon 144 may in an extreme case provide stability in certain weather conditions as the bow 26 may be lifted off the water. Although this is unlikely, the stern pontoon 144 does provide an inflated buffer substantially surrounding the rearward and side exposed portions of the motor 116 without negatively affecting waterflow directed rearward from the propeller 150 or other propelling apparatus being driven by the motor 116.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. An open bow inflatable boat to operate on water comprising:

a. port and starboard longitudinal inflatable hull pontoons;

b. an inflatable floor attached to and extending between the port and starboard hull pontoons;

c. a bow pontoon continuous with the port and starboard longitudinal inflatable hull pontoons;

d. the bow pontoon forward of and above the inflatable floor;

e. surfaces defining an open bow region bounded by the port and starboard longitudinal inflatable hull pontoons, bow pontoon, and the inflatable floor;

f. a hull tarp exterior of the bow pontoon and releasably in contact with the bow pontoon so as to selectively cover the open bow region.

2. The open bow inflatable boat as recited in claim 1 further comprising:

a. a stern pontoon continuous with the port and starboard longitudinal inflatable hull pontoons;

b. the stern pontoon forward of and above the inflatable floor; and c. surfaces defining an open stern region bounded by the port and starboard longitudinal inflatable hull pontoons, bow pontoon, and the inflatable floor.

3. The open bow inflatable boat as recited in claim 1 wherein the inflatable floor comprises tapered tubes which are larger in a vertical dimension at an aft end than at a forward end.

4. The open bow inflatable boat as recited in claim 1 further comprising:

a. a frame removably attached to and extending between the port and starboard longitudinal inflatable hull pontoons.

5. The open bow inflatable boat as recited in claim 4 wherein the frame is modular comprising components selected from the list consisting of: a seat, transverse frame members, longitudinal frame members, control console, storage locker, and a rigid floor section.

6. The open bow inflatable boat as recited in claim 1 further comprising:

a. a plurality of straps having a first end attached to the hull tarp and a second end comprising a fastening mechanism;

b. a float which is lighter than water attached to each strap between the first end and the second end; and c. wherein each float has sufficient positive buoyancy to maintain the fastening mechanism at the water's surface.

7. The open bow inflatable boat as recited in claim 1 further comprising:

a. a plurality of fastening points fixed to the boat;

b. a plurality of quick release fasteners removably attaching the bow section of the hull tarp to the bow portion of the boat.

* * * * *